US005694640A

United States Patent [19]

Greetham

[11] Patent Number: 5,694,640

[45] Date of Patent: Dec. 2, 1997

[54] METHOD OF AND APPARTUS FOR PRODUCING A COMPRESSION PRODUCT

[75] Inventor: Geoffrey Greetham, Ipswich, United Kingdom

[73] Assignee: Manganese Bronze Components Limited, Suffolk, United Kingdom

[21] Appl. No.: 617,923

[22] PCT Filed: Sep. 7, 1994

[86] PCT No.: PCT/GB94/01941

§ 371 Date: Mar. 8, 1996

§ 102(e) Date: Mar. 8, 1996

[87] PCT Pub. No.: WO95/07157

PCT Pub. Date: Mar. 16, 1995

[30] Foreign Application Priority Data

Sep. 8, 1993 [GB] United Kingdom ..... 9318581

[51] Int. Cl.[6] ..... B22F 1/00

[52] U.S. Cl. ..... 419/38; 419/66; 264/56; 264/67; 425/78

[58] Field of Search ..... 264/56, 67; 419/38, 419/66; 425/78

[56] References Cited

FOREIGN PATENT DOCUMENTS

| | | |
|---|---|---|
| 1148708 | 4/1985 | U.S.S.R. . |
| 1315135 | 6/1987 | U.S.S.R. . |
| 1000255 | 8/1965 | United Kingdom . |
| 1220592 | 1/1971 | United Kingdom . |
| 1337709 | 11/1973 | United Kingdom . |

OTHER PUBLICATIONS

Soviet Inventions Illustrated, P,Q sections, week 9132, issued 1991, Sep. 25, Derwent Publications Ltd., London; & SU,A,1592 119 (Makarov V K).

Soviet Inventions Illustrated, P,Q sections, week 8803, issued 1988, Mar. 02, Derwent Publications Ltd., London; & SU,A,1315 135 (ARC Hard Alloy STEE) (cited in the application).

Soviet Patents Abstracts, Sep. 1991, re SU–A 1592–119.

Beghenkov et al, "51 Novel Method of Powder Compaction"PM90 Report on World Conference on Powder Metallurgy Jul. 1990 pp. 289–292.

*Primary Examiner*—Charles T. Jordan
*Assistant Examiner*—Anthony R. Chi
*Attorney, Agent, or Firm*—Cushman, Darby & Cushman, IP Group of Pillsbury, Madison & Sutro LLP

[57] ABSTRACT

A method of producing components by compressing powdered material in a hollow die includes the use of a sleeve in the die to reduce the pressure required to remove the product from the die after compression, and to reduce cracking in the product after spring-back upon release of the component. An elastically deformable sleeve having a cylindrical internal surface and conical external surface is inserted into a tapered aperture in a die plate so as to reduce elastically the internal diameter of the sleeve. The component is produced by compressing powdered material in the interior of the sleeve by upper and lower punches. The upper punch is then removed and the sleeve is partially removed with the product from the die, by movement against the direction of the taper. The interior dimension of the sleeve increases elastically and the product is then removed from the sleeve by raising the lower punch.

15 Claims, 8 Drawing Sheets

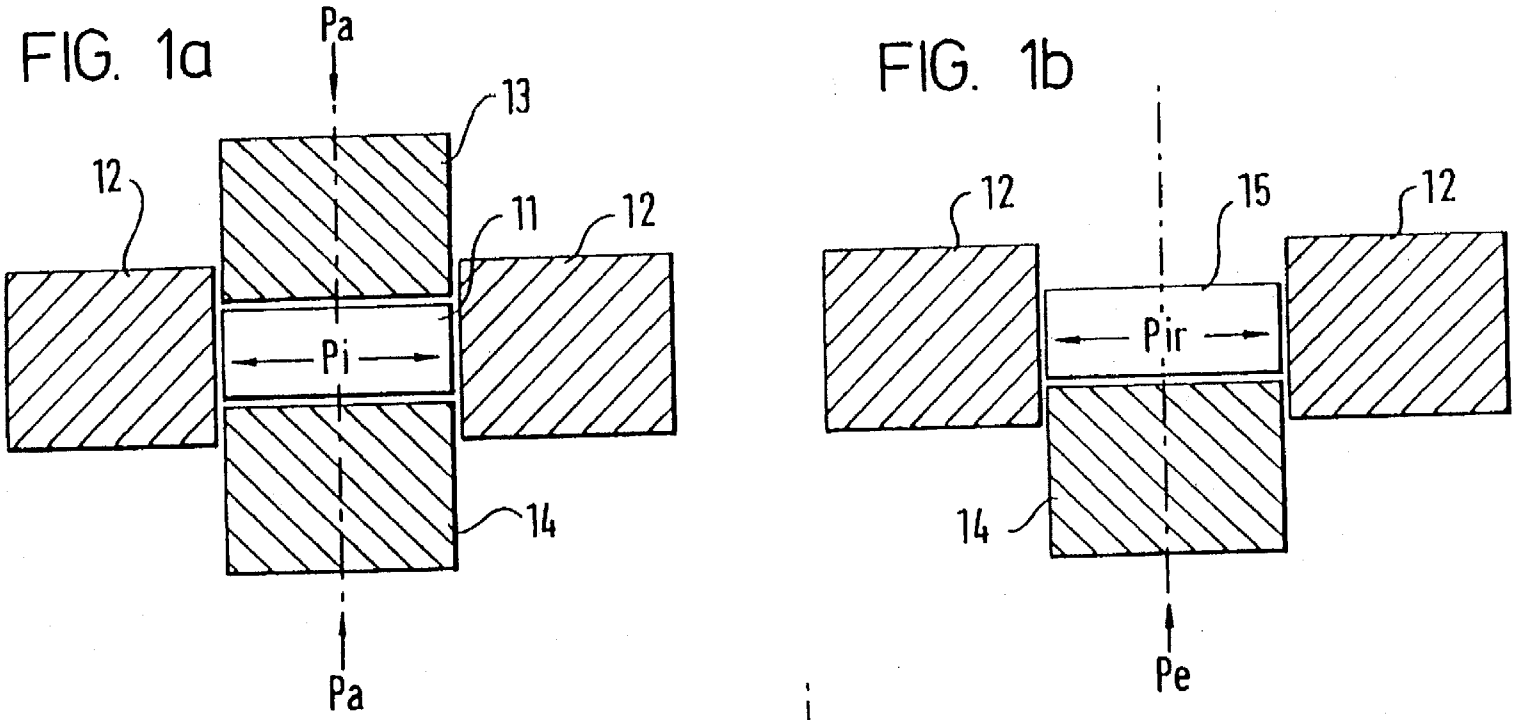
FIG. 1b
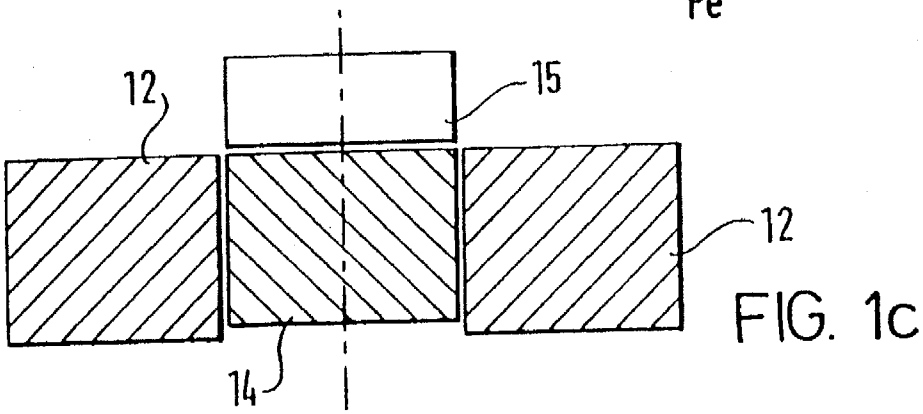
FIG. 1c
FIG. 1a

FIG. 12a
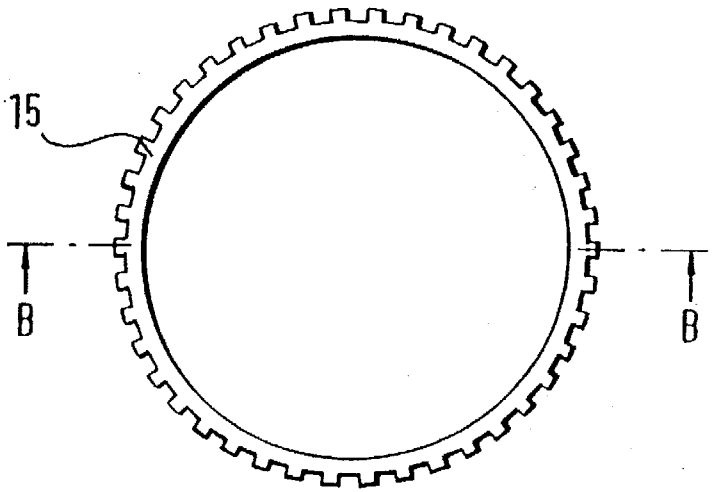
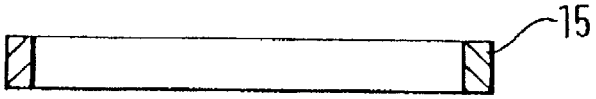
FIG. 12b
FIG. 11a
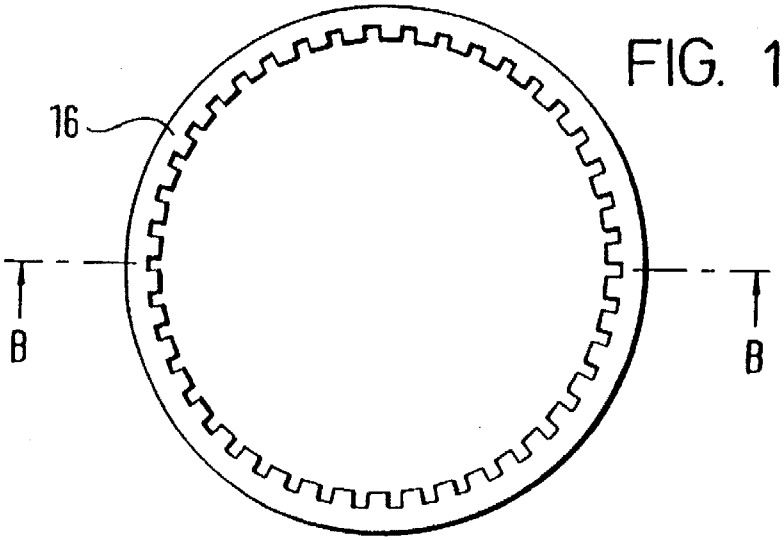
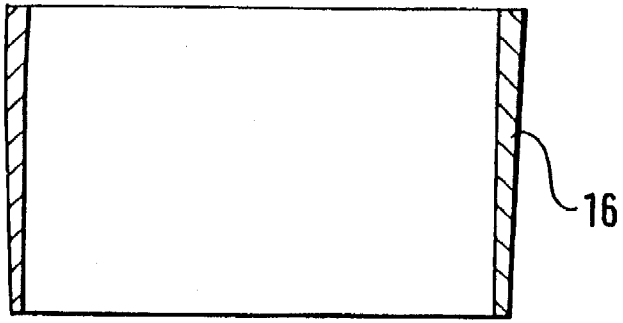
FIG. 11b

METHOD OF AND APPARTUS FOR PRODUCING A COMPRESSION PRODUCT

This application claims benefit of international application PCT/GB94/01941, filed Sep. 7, 1994.

The present invention relates to a method of, and apparatus for, producing a product by compression of material, particularly but not exclusively by compression of powdered metallic material.

Many components for industrial applications are manufactured by the powder metallurgy route in which metal powders are formed into the desired shape with very little waste material and with high dimensional accuracy. However, the mechanical and physical properties of powder metallurgical materials depend significantly on the final density of the component. In general, mechanical strength improves dramatically as density is increased and, for example, in magnetic materials the permeability increases with increase in density.

Many shaped components are made by pressing powder in fixed dies using, in its simplest form, a die with top and bottom punches. FIGS. 1*a*, *b* and *c* show a section through a die set used to produce a cylindrical object. Powder 11 is placed in the die 12 and the top and bottom punches 13 and 14 compress the powder (FIG. 1*a*). The top punch 13 is then removed as in FIG. 1*b*, and the compressed powder is ejected as a compact 15 which has sufficient strength to be handled, but insufficient to be used as a component (FIG. 1*c*). The compact is subsequently passed through a furnace at the appropriate temperature to induce diffusion between the powder particles. This so-called sintering process converts the pressed powder into a continuous material with sufficient strength for the proposed application of the component.

One of the problems associated with pressing in a fixed die system relates to the compressibility of the powder and how the pressed compact is removed from the die. As the powder is pressed in the die set its density increases due to the increasing pressing pressure used during the pressing cycle. The compacted powder exerts an internal pressure Pi on the die walls, and the greater the axially applied pressure Pa the greater the internal pressure on the die walls (as shown in FIG. 1*a*). When the pressing pressure is removed there is still a residual stress in the compact 15 which exerts a pressure Pir on the die walls (as shown in FIG. 1*b*). It is necessary to use an ejection force Pe (FIG. 1*b*) to overcome this die wall pressure and to eject the compact from the die.

As the compact 15 is being ejected from the die 12 (as shown in FIG. 2), it is subjected to external shear forces Fe on its external surface due to the restraining effect of the die. As the axial pressing pressure Pa (previously applied) increases, this shear force Fe (arising during release) also increases, making it more difficult to eject the component. Hence the ejection force Pe which is required increases, and there is a danger of the compact damaging the die walls, and the compact itself being damaged by the contact with the die walls. Additionally, as the compact 15 emerges from the die 12 it is no longer restrained by the die as in FIG. 3, and as there are elastic stresses in the compact due to the pressing operation the compact is able to change its shape to relieve these elastic stresses. This is known as 'spring-back'. This means, for example as shown in FIG. 3, that a powder compact 15 compressed in a die 12 of a specific internal diameter D, will, on ejection, have a diameter D+dc, where dc is the increase in diameter of the compact on ejection. This spring-back effect can result in the pressed compact developing cracks at right angles to the pressing direction, due to the difference in diameter of the part of the compact still in the die (with a diameter D), and the part which has been ejected free from the die (with a diameter D+dc). At the change in diameter at the top face of the die cracks can be formed.

In order to produce high density components it is necessary to obtain as high a density in the pressed powder compact as possible, but as is now evident the higher the pressing pressure the more difficult it is to remove the compact from the die. The ejection forces will need to be higher the higher the compaction pressure, and there is a high probability that the die, and/or the compact will be damaged during the ejection stroke. There is also the problem that the spring-back effect will increase as the pressing pressure increases leading to damaged compacts on ejection. These problems normally mean that pressing pressures, and therefore pressed densities, are restricted when using fixed dies.

In SU-A-1315135 (Zlobin et al) there is disclosed apparatus for producing a compacted article by compression of metal powder. A die is formed of three partible units and has a slotted elastic shell inside the die. The external surface of the die units is conical and is enclosed in a corresponding conical hole of a thrust ring. Axial movement of the thrust ring clamps the units of the die towards each other and compresses the slotted shell closing its slot. Then, metal powder is charged into the shell acting as an inner liner of the die, and the powder is compacted by a single ended pressing punch. After compaction, the thrust ring is pressed downwardly which opens the die, releasing the compacted article.

One disadvantage of such an arrangement in practical use is that the powder to be compacted finds its way into the slot in the inner lining of the die. The behaviour of metallic powders during compaction is not that of a fluid. The region of the powder adjacent the moving punch will compact first, whilst powder remote from the piston will not at first be compressed. The pressure of compaction will mean that some opening at the slot will exist, and powder will be forced into this opening. Also generally during operation of the machine, despite cleaning, powder will build up in the crack of the shell, and that powder will itself be compacted during subsequent operations. The result is that it will not be possible to close completely the slot in the shell in subsequent operations, which means that accuracy is lost both in the dimensions of the compact produced, and in the provision of protrusions at the surface of the compact where the slot has been positioned. Other disadvantages of the arrangement are that the thrust ring will not apply pressure evenly to the inner shell. Furthermore, since the shell is slotted, the tensions in the shell will vary from compression where the edges of a slot abut each other, to tension on the outside of the shell diametrically opposite the slot. Such tensions will prevent compression of the slotted shell uniformly around the perimeter of the lining, which will again reduce accuracy of the compact being produced.

In a paper entitled "NOVEL METHODS OF POWDER COMPACTION" by G. I. Begenkoff and G. B. Zlobin, at pages 289 to 292 of the report of PM90, World Conference on Powder Metallurgy held on 2–6 Jul., 1990 in London, there is disclosed apparatus for producing a compact from powder. The apparatus comprises a die formed of segments and having an outer conical surface, the segments being held together by a holder having a tapered opening corresponding to the taper of the die segments and in which the die segments are positioned. A single ended, upper pressing ram compresses powder in the segmented die against inwardly directed flanges of the die segments, and at the same time presses the die segments into the conical opening in The holder. During formation of the compact, the compacting pressure is transferred through the compact to the lower ram and die segment flanges, which causes the die segments to be radially compressed by the conical side walls of the tapered holder. When the load is removed from the upper ram, the die segments move apart under the lateral pressure exerted by the holder, sliding upwards along the inclined faces of the holder. The value of the taper angle of the holder is more than the angle of friction between the die segment and the holder.

The disadvantages of this arrangement are similar to those in the patent mentioned hereinbefore, in that the separate die segments will again provide openings between the segments into which powder will find its way during compression. This is particularly acute in the example of the referenced paper, because the force provided to compress inwardly the die segments arises from the compaction force of the ram compressing the product material. Thus at the beginning of She compression stroke, the die segments will not be compressed inwardly, leaving even larger gaps for the powder to migrate into. Other disadvantages include the fact that it is not possible to vary the inward force on the die segments independently of the load force applied for compaction of the product.

According to the present invention there is provided a method of producing a product by compression of material, comprising the steps of: providing in a hollow die a compressed lining which is elastically compressed so as to reduce the internal size of the lining relative to the internal size before compression, compressing product material in the lining to produce a compressed product, releasing the lining at least partially from the die to produce an increase in the internal size of the lining, and removing the compressed product from the lining, in which the lining is continuous around the interior the die.

The provision of a continuous lining avoids the difficulty of powder finding its way into slots or other openings with consequent lack of accuracy. It is preferred that the lining is compressed by elastic deformation of the lining material uniformly around the perimeter of the lining. The required reduction in internal size of the lining can be obtained not by the movement of separated parts of a lining or die towards each other but by the uniform elastic deformation of the bulk material of the lining, as a result of inward pressure applied to the lining. This allows accuracy to be maintained, even in die shapes having a complicated interior surface, by arranging for uniform forces to be applied around the lining, to produce a smooth continuous elastic deformation of the lining material. This produces an internal shape of the lining which is reduced in size, but maintains dimensional integrity with the desired shape for the finally compressed product.

It is believed that in the prior art set out above a slot in a sleeve was used because it was thought that a large recovery movement was required upon release of the sleeve and that this could only be achieved by a slot. It has now been found, unexpectedly, that the elastic recovery from a continuous lining can be made to be of the same order as the springback of the component being made, so that a continuous lining can be used, which gives rise to an industrially viable process.

It is to be appreciated that the steps set out in accordance with the invention are not necessarily performed separately in the order given, and that the order may be varied, and indeed may overlap. For example the reduction in size of the lining may be produced partly or completely before insertion of the lining in the die, for example by compression of the lining in another member before insertion into the die. In other arrangements, the internal size of the lining may be decreased during the pressing operation itself. However, preferably the compression of the lining in the die is achieved during the step of inserting the lining into the die. The material to be compressed may be placed in the lining before or after the lining is inserted into the die, but normally the material will be inserted after the lining is inserted into the die. The invention is particularly applicable where the method includes placing the product material in the interior of the lining in powdered form, and compressing the material into a rigid product.

Depending upon the shape and application of the lining, the changes in internal and/or external size of the lining may be changes in one or more than one dimension. Although the lining may assume a number of shapes, depending upon the shape of the die, the invention is particularly applicable where the lining is a sleeve and the method includes inserting the sleeve into the die along the direction of a common axis of the sleeve and the die. Preferably the exterior of the sleeve and the interior of the die are both tapered, and the method includes inserting the sleeve into the die in the direction in which the sleeve and die are tapered.

The invention has particular application where the lining is compressed by the step of compressing the lining by elastic deformation of the lining material uniformly around the perimeter of the lining, and preferably is compressed by the step of compressing the lining before the step of compressing the product material to produce the compressed product. In some preferred forms, the method includes the step of producing an adjustable, selectable compression of the lining, whereby the increase in internal size of the lining on release of the lining from the die can be selected in relation to the expected increase in external size of the product on release from the die. However, in some production examples, the apparatus used will be set so as to produce a predetermined compression of the lining, for a particular product to be made.

The amount of compression of the lining will be chosen according to the requirements of the product, but preferably the method includes compressing the lining to an extent such that the increase in internal size of the lining on release of the lining from the die is in the range + or −20% of the increase in external size of the product on release from the die, preferably the range being + or −10%. Normally the lining will be compressed to an extent such that the increase in internal size of the lining during release from the die is at least equal to the expansion of the product after release from the die, preferably substantially equal to the expansion of the product.

Although it may be arranged that the product has a generally circular perimeter, and the said increase of size of the product and the lining is an increase in radius thereof, other shapes of die and lining may be provided, such as an oval, or a complex shape such as that of an engine connecting rod. The outer surface of the sleeve and the inner surface of the die may assume a number of shapes, but conveniently the outer surface of the sleeve and the inner surface of the die are both circular in cross section.

In many arrangements the interior surface of the sleeve is circular in cross section. However the interior surface of the sleeve may have the configuration of a mould for producing an article of generally circular cross section but having a varying shape around its perimeter, e.g. the configuration of a mould for producing a gear wheel. Thus the interior surface of the sleeve may have a configuration such that the distance of the surface from the axis of the sleeve varies around the interior surface of the sleeve. In some arrangements the interior surface of the sleeve has a cross section which is constant along the direction of the axis of the sleeve, but in other arrangements the interior surface of the sleeve has a cross section which varies in the direction of the axis of the sleeve, for example in discontinuous steps.

The invention finds particularly preferred application where the lining is a sleeve and the method includes inserting the sleeve into the die along the direction of a common axis of the sleeve and the die, and in which the interior of the die is tapered in the direction of the common axis so that insertion of the sleeve produces compression of the sleeve by the die. Preferably the exterior of the sleeve is also tapered, in the same sense as the taper of the interior of the die, and preferably the angle of taper of the sleeve is the same as the angle of taper of the die. Preferably the angle of taper of the die is in the range 0.5 to 10', most preferably in the range 1 to 5°, and particularly preferably about 2°.

The invention finds particular application where the hollow die is provided by an aperture in a die and the method includes compressing the material by moving upper and lower punches into the aperture in the die in the interior of the lining. However the invention is equally applicable with rotary compaction to densify powder. Rotary compaction is a known process having the following main steps.

The bottom of the top punch of a rotary compaction die set has a conical surface and the central axis of the top punch is offset with respect to the central axis of the die at such an angle that when the top punch is lowered onto the powder, a line contact is produced between the top punch and the powder. This contrasts with the whole of the bottom surface of the top punch in a conventional die set contacting the surface of the powder. The line contact in rotary compaction is made to rotate about the centre line of the die by a suitable mechanical means. Methods to produce this are well known. Nominal line contact means that much higher specific pressures are applied to the powder, resulting in high density compacted material.

In accordance with one particular feature of the invention, there is provided a method of calibrating the die and lining by the steps of:

(a) pressing the sleeve into the die and measuring the change in inner diameter of the sleeve as a function of the change in axial position of the sleeve;

(b) for any particular product material, measuring the compressibility and spring back as a function of the pressing pressure;

(c) for a required pressing density during production of a compressed product, determining from the information of step (b) the spring back which would occur in a conventional die; and (d) determining from the data acquired in step (a) the extent of insertion of the sleeve that is required to give a value of decrease of inner diameter of the sleeve which is equal to the expected spring back determined in step (c), or falls within a predetermined range of deviation from that springback.

There will now be set out a number of independent aspects of the invention, which may be utilised independently of the main features set out above. In one further aspect of the invention there may be provided a method of producing a product by compression of material, comprising the steps of: providing in a hollow die a compressed sleeve which is elastically compressed so as to reduce the internal size of the sleeve relative to the internal size before compression, inserting into the compressed sleeve a material to be compressed, compressing the material in the sleeve to produce a compressed product, releasing the sleeve at least partially from the die to produce an increase in the internal size of the sleeve, and removing the compressed product from the sleeve, in which the interior surface of the die and the exterior surface of the sleeve are both tapered, the method including the step of inserting the tapered sleeve into the tapered die and compressing the sleeve by the effect of the tapered surfaces, before the compression of the material in the sleeve to produce the product.

In yet another aspect of the invention there may be provided a method of producing a product by compression of material, comprising the steps of: providing in a hollow die a compressed lining which is elastically compressed so as to reduce the internal size of the lining relative to the internal size before compression, compressing product material in the lining to produce a compressed product, releasing the lining at least partially from the die to produce an increase in the internal size of the lining, and removing the compressed product from the lining, including the step of compressing the lining by elastic deformation of the lining material uniformly around the perimeter of the lining.

In a yet further aspect, there may be provided in accordance with the invention a method of producing a product by compression of material, comprising the steps of: providing in a hollow die a compressed lining which is elastically compressed so as to reduce the internal size of the lining relative to the internal size before compression, compressing product material in the lining to produce a compressed product, releasing the lining at least partially from the die to produce an increase in the internal size of the lining, and removing the compressed product from the lining, including the step of producing an adjustable, selectable, compression of the lining, whereby the increase in internal size of the lining on release of the lining from the die can be selected in relation to the expected increase in external size of the product on release from the die.

Finally, in accordance with another aspect of the invention, there may be provided a method of producing a product by compression of material, comprising inserting into a hollow die a core which is elastically expanded; compressing product material in the die around the core; after the compression of the product material, reducing the size of the core; and removing the compressed product from the die and from the core.

It is to be appreciated that where features of the invention have been set out in accordance with a method of the invention, these features may also be provided in accordance with an apparatus according to the invention. In particular there may be provided in accordance with the invention in a first aspect apparatus for producing a product by compression of material comprising: a hollow die; an elastically compressible lining for the die; means for compressing the lining to provide in the die a compressed lining of reduced internal size; means for compressing material in the interior of the lining when inside the die, and means for releasing the lining at least partially from the die to produce an increase in the internal size of the lining to allow removal of the compressed product from the lining, in which the lining is a continuous lining for the interior of the die. Preferably the lining has, when uncompressed, an external size greater than the internal size of the die, and the means for compressing the lining comprises means for forcing the elastically compressible lining into the die so as to compress the lining.

In accordance with another aspect of the invention, there may be provided apparatus for producing a product by compression of material comprising: a hollow die; an elastically compressible lining for the die; means for compressing the sleeve to provide in the die a compressed sleeve of reduced internal size; means for compressing material in the interior of the sleeve when inside the die, and means for releasing the sleeve at least partially from the die to produce an increase in the internal size of the sleeve to allow removal of the compressed product from the sleeve, in which the interior surface of the die and the exterior surface of the sleeve are both tapered and the means for compressing the sleeve comprises means for forcing the sleeve into the die independently of the means for compressing the material in the interior of the sleeve.

There is also provided in accordance with the invention a product formed by compression of material in accordance with the steps of the method set out, or by use of the apparatus set out.

The invention can provide simple means which have been found to be effective in overcoming the problems set out hereinbefore enabling high pressing pressure to be applied whilst still being able to remove the pressed product from the die without damage to either the compact or the die set.

Embodiments of the invention will now be described by way of example with reference to the accompanying drawings in which:

FIGS. 1*a*, *b* and *c* are diagrammatic representations, in cross section, of known apparatus for producing a product by compression of powdered material;

FIGS. 2 and 3 are diagrammatic representations, in cross section, showing the ejection of a compressed product from a die, in accordance with known arrangements;

FIGS. 4 and 4*a* to 4*f* are diagrammatic representations in cross section of apparatus embodying the invention for producing a product by compression, and illustrate steps in the method of use of this apparatus FIG. 5 is a graph showing diagrammatically the relationship between the extent of insertion of a sleeve in a die of the invention, and the change in inner diameter of the sleeve, in relationship to load applied to the sleeve;

Figure 9:
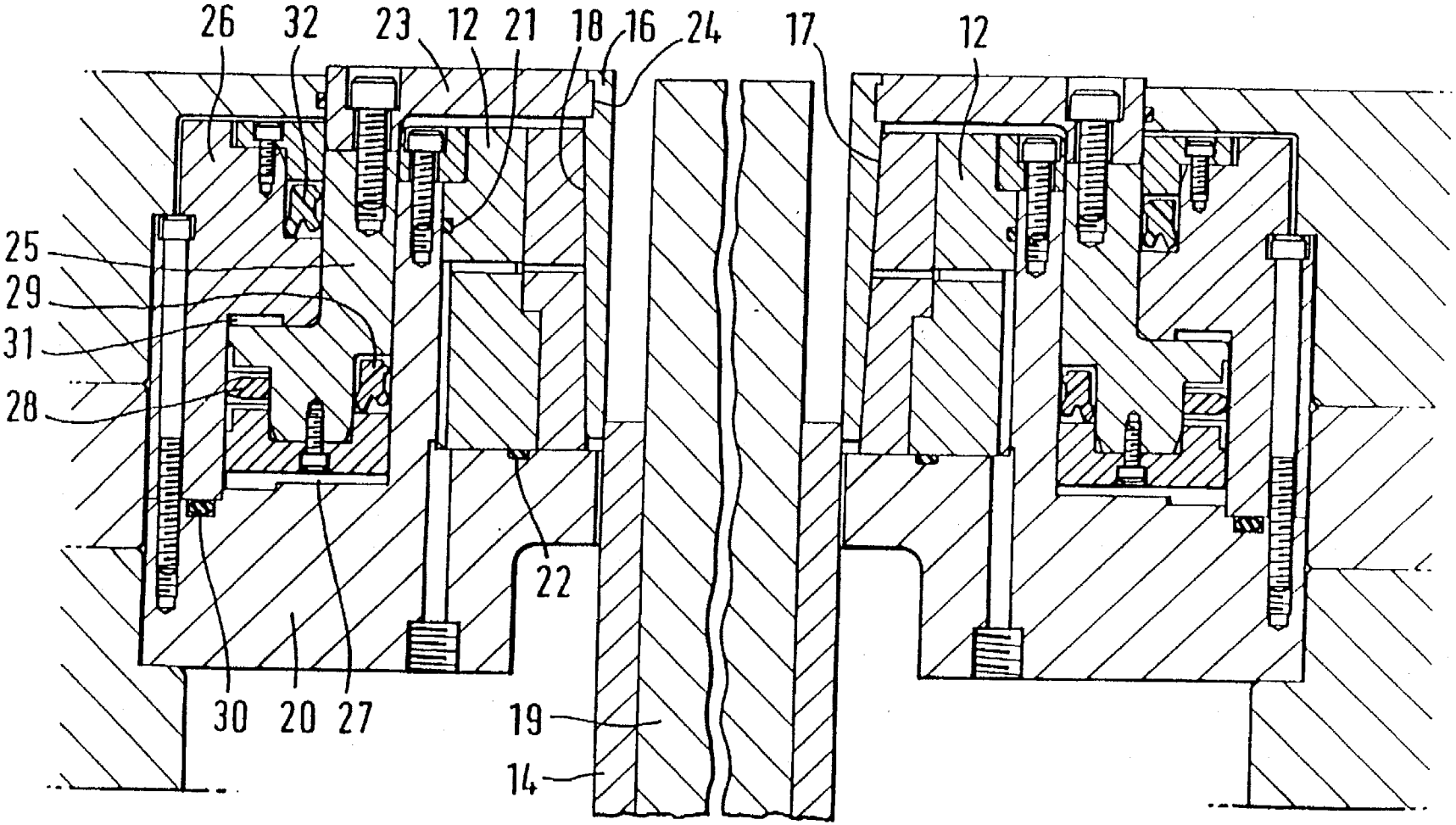
FIG. 9 is a cross-section through a production tooling apparatus for producing a compressed product, embodying the invention, showing the apparatus at the beginning of a compression cycle.
Figure 10:
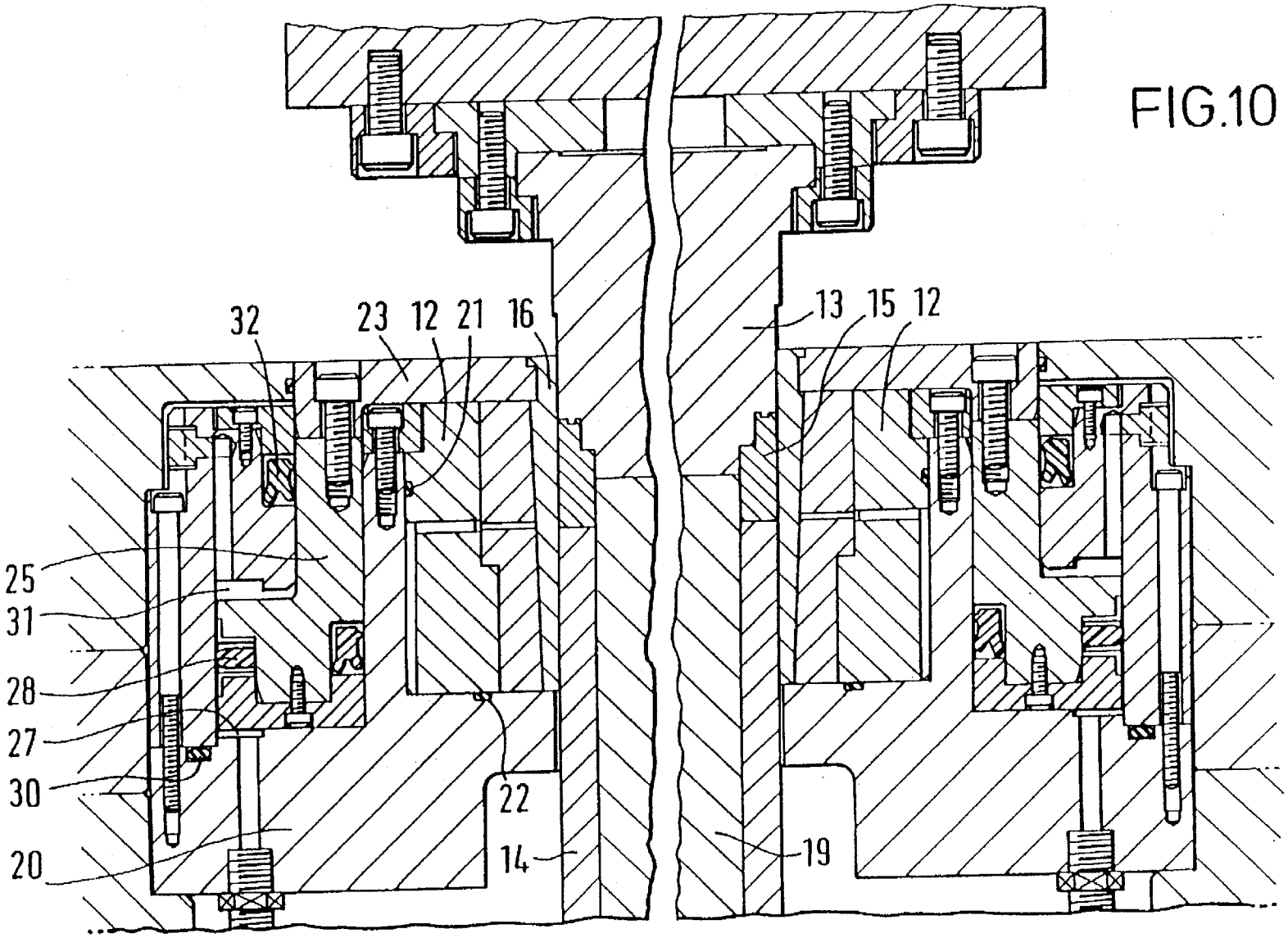
FIG. 10 is a cross-section of the apparatus of FIG. 9, shown at the end of a compression cycle.

FIGS. 11*a* and 11*b* show respectively a plan view and a section along lines B—B in FIG. 11*a* of a sleeve suitable for use in the apparatus of FIGS. 9 and 10, to produces a gearwheel;

FIGS. 12*a* and 12*b* show respectively a plan view and section along lines B—B in FIG. 12*a* of a gearwheel produced by the sleeve of FIGS. 11*a* and 11*b*.

Figure 2:
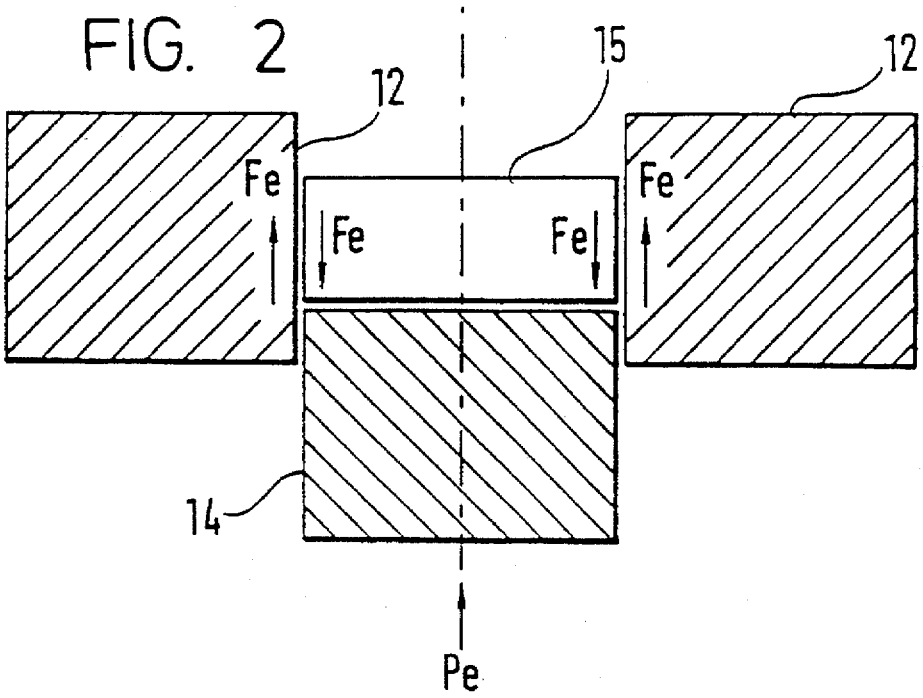
Figure 3:
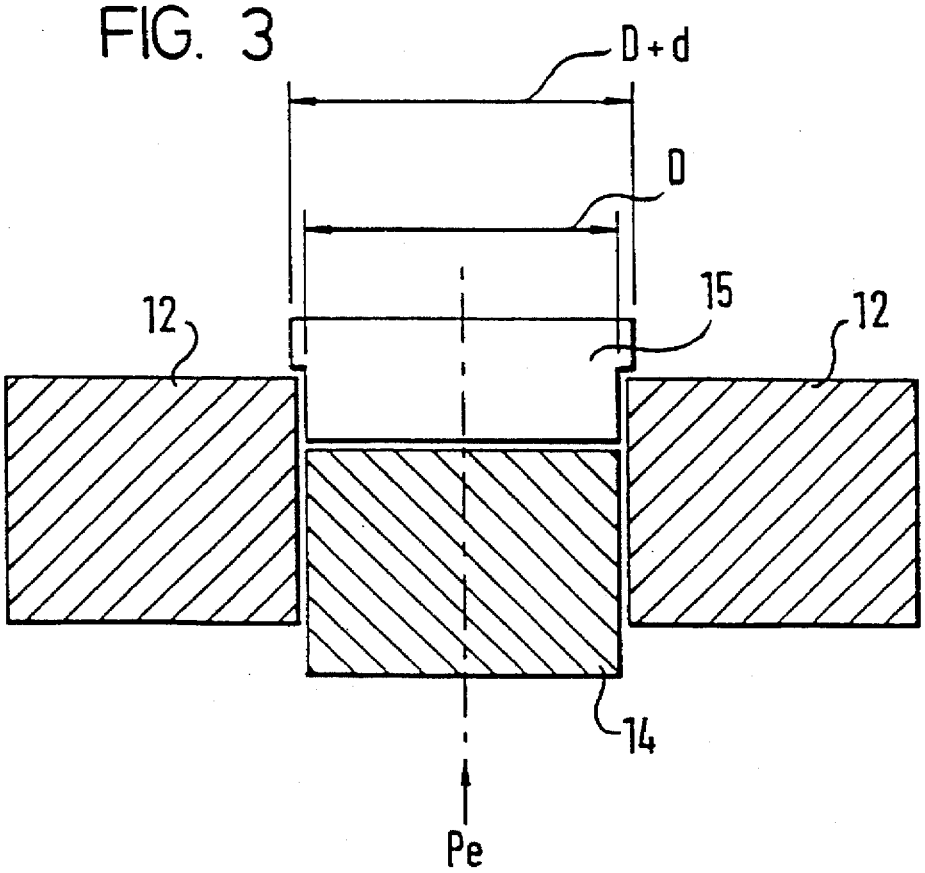
Figure 4:
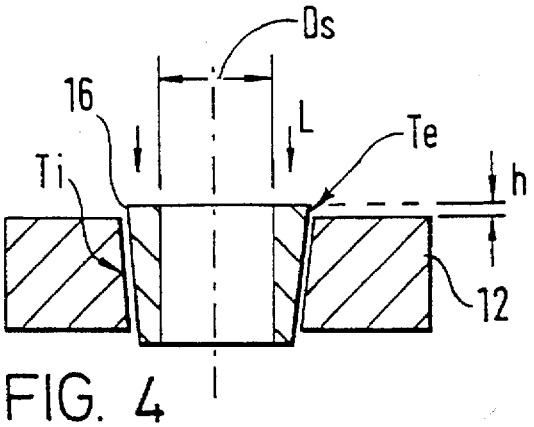

As has been described in the introduction to the specification, FIGS. 1*a* to 1*c* illustrate a known apparatus for producing a product by compression, comprising a die 12 and upper and lower punches 13 and 14 for compressing powdered material 11, to produce a compact 15. FIG. 2 illustrates the shear forces which arise during ejection of the compact 15, and FIG. 3 illustrates the change of diameter which occurs in the compact during ejection, in known methods. FIGS. 4 and 4*a* to 4*f* are diagrammatic representations in cross section of apparatus embodying the invention for producing a product by compression, and illustrate steps in the method of use of this apparatus. In these Figures, components corresponding to components shown in previous Figures are indicated by like reference numerals. As shown in FIG. 4, the modifications to the die set in accordance with this embodiment of the invention involve the introduction of a relatively thin, elastically deformable inner sleeve 16 to the die 12 as shown in FIG. 4. This sleeve 16 has an external taper Te, which is matched by an internal taper Ti in the die bore, and has an unstressed inner diameter of Ds.

Figure 4A:
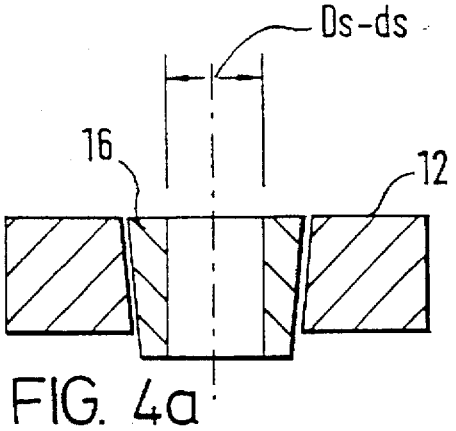
Figure 4B:
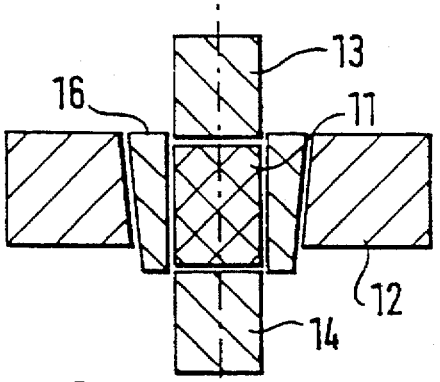
Figure 4C:
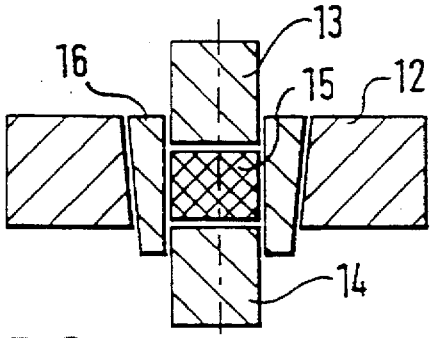
Figure 4D:
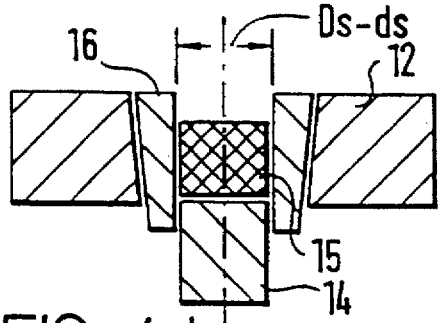
Figure 4E:
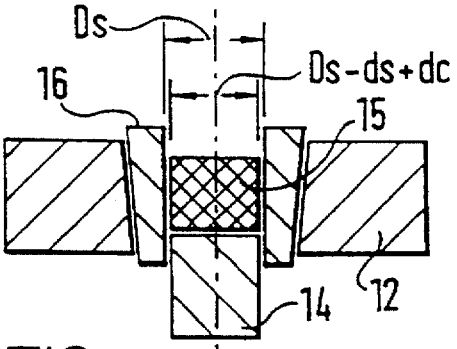
Figure 4F:
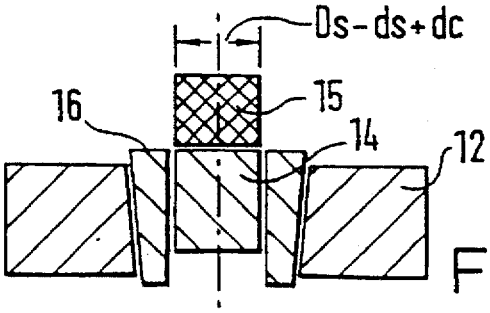
Figure 5:
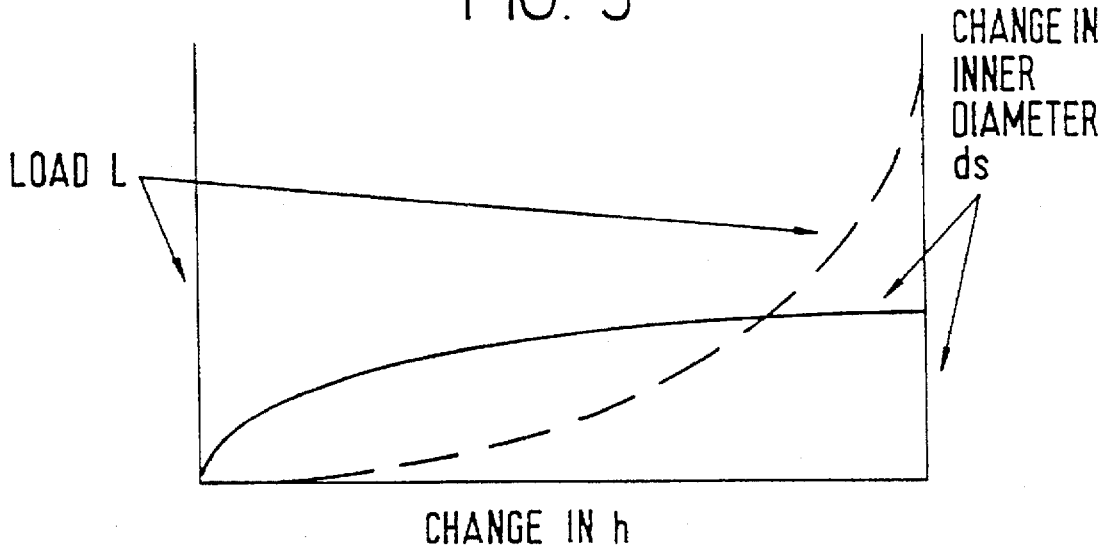
Figure 6:
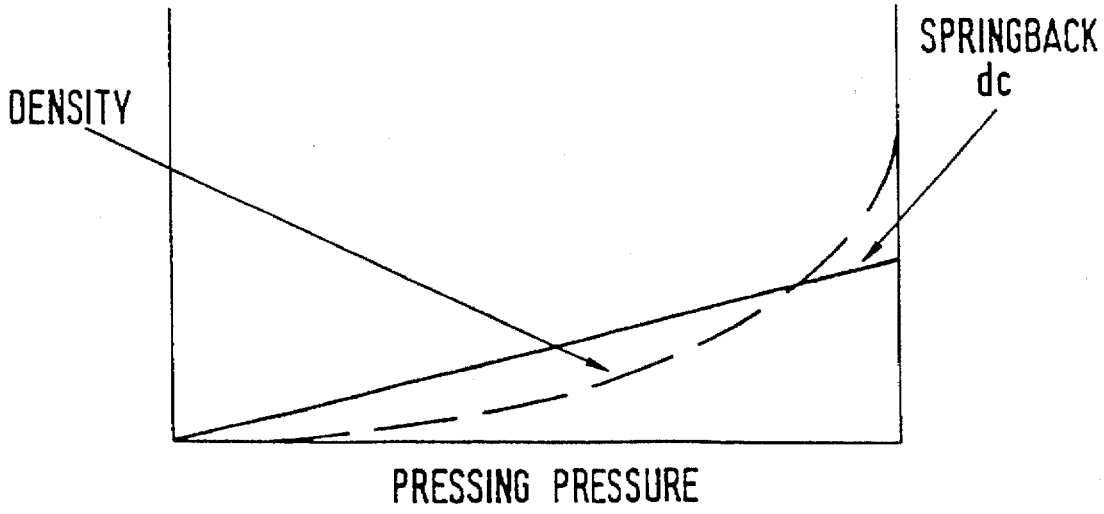
FIG. 6 is a graph showing the relationship between density and springback of a compact formed in an embodiment of the invention.

One method of operation is as follows. In the first step, the inner sleeve 16 is pressed into the die 12 as shown in FIG. 4*a*. During this movement a compressive stress is generated in the sleeve 16 and the inner diameter Ds of the sleeve is reduced by an amount ds which is dependant on the relative movements of the inner sleeve with respect to the die 12. The further the sleeve is pressed into the die the greater will be the value of ds. This movement has to be elastic in nature such that when the inner sleeve 16 is subsequently pushed out of the die, the inner diameter recovers to its former value Ds. Next, the bottom punch 14 is entered into the die and the powder 11 is placed in the inner sleeve 16. The top punch 13 is then inserted into the die, as shown in FIG. 4*b*. The top punch and bottom punches 13 and 14 are pressed into the die to compact the powder 11, as shown in FIG. 4*c*. At this stage the inner diameter of the sleeve 16 is DS-ds and the diameter of the compressed compact 15 is also Ds-ds. The next step is that the top punch 13 is removed, as shown in FIG. 4*d*. The bottom punch 14, inner sleeve 16 and the compact 15 are then all moved upwards together relative to the die 12, releasing the inner sleeve 12 from the taper of the bore, as shown in FIG. 4*e*. During this step the inner diameter of the sleeve 16 recovers to its original diameter Ds. As the diameter of the inner sleeve 16 is increased to this original diameter the compact also increases in diameter due to the 'spring-back' effect, that is to say the relief of the elastic stresses in the compact due to the pressing operation. The diameter of the compact becomes Ds-ds+dc, where dc is the change in diameter due to the spring-back effect. Lastly, the compact 15 is ejected from the inner sleeve 16 by moving the bottom punch 14 relative to the inner sleeve 16, as shown in FIG. 4*f*.

Two significant points arise. If the value of ds is arranged so that it is equal to, or slightly greater than, dc, then at the last step the inner sleeve 16 will not be in contact with the compact 15, and the ejection force required for the last step will be low. Also, it is to be noted that in the movement of the sleeve 16 and compact 15 to partially release the sleeve and the compact from the die 12 (the movement from FIG. 4*d* to FIG. 4*e*), the internal diameter of the sleeve 16 resumes its previous diameter of Ds in a single movement which is uniform throughout the height of the sleeve 16. This arises because the sleeve 16 is released from the taper of the bore of the die 12 uniformly throughout its length. The advantage is that the compact 15 is allowed to expand to its final diameter in a uniform movement throughout the length of the compact. This avoids cracking due to gradual change of diameter as shown in the known arrangement of FIG. 3.

In practice, for any specific pressing pressure the value of dc can be obtained experimentally by pressing compacts in a die of fixed size and measuring the diameter of the compact on ejection. The sleeve is then designed such that ds is greater than dc. This design be either by calculation from the known mechanical properties of the sleeve materials used, or by trial and error. The essential part of the process in the embodiment described is that the internal diameter of the inner sleeve has to decrease elastically before or during the pressing operation, and on removal of the sleeve from the die an elastic recovery of the internal diameter of the die takes place, preferably slightly greater than the elastic recovery of the external diameter of the compact. Although the geometry has been described in terms of a solid cylindrical component, the technique is applicable to other shapes, for example washers or hollow cylinders. These may have non-circular external shapes, such as various gear forms. It is also to be appreciated that the technique can be used for the re-repressing of partially sintered powder metallurgy compacts, and also fully sintered compacts either to increase their density or to press them to final, accurate, dimensions.

There will now be described with reference to FIGS. 4 and 4*a*, and FIGS. 5 to 8, a method of calibrating the die and lining shown in FIGS. 4 to 4*f*. In summary, this calibration is achieved by the steps of:

(a) pressing the sleeve into the die and measuring the change in inner diameter of the sleeve as a function of the change in axial position of the sleeve;

(b) for any particular product material, measuring the compressibility and spring back as a function of the pressing pressure;

(c) for a required pressing density during production of a compressed product, determining from the information of step (b) the spring back which would occur in a conventional die; and (d) determining from the data acquired in step (a) the extent of insertion of the sleeve that is required to give a value of decrease of inner diameter of the sleeve which is equal to the expected spring back determined in step (c), or falls within a predetermined range of deviation from that springback.

Referring to FIG. 4, the reference letter h indicates the height of the sleeve 16 above the top of the die 12, and L indicates the load on the sleeve 16 during insertion of the sleeve into the tapered bore in the die 12. The first calibration step, step (a), consists of pressing the sleeve 16 into the die 12 under the load L and measuring the change in the protruding height h and the change in the inner diameter of the sleeve ds which results. The inter-relationship between these measured parameters, is shown diagrammatically in FIG. 5. In this Figure the abscissa coordinate of the graph shows change in height h. The ordinate coordinate shows for the broken line the load L, and for the continuous line, the change in inner diameter ds of the lining 16.

The second step of calibration, step (b), is the measurement for any particular powder, of the compressibility and springback as a function of pressing pressure. The springback is the difference between the inner diameter of the die and the outer diameter of the compact when ejected from the die. The relationship between density and springback is shown schematically in FIG. 6. In this figure the ordinate coordinate shows the pressing pressure acting on the powder during formation of the compact. The abscissa coordinate shows in respect of the broken line the density of the compact after termination at a given pressing pressure and after ejection from the die. The ordinate coordinate shows in respect of the continuous line the springback of the compact after ejection from the die.

Figure 7:
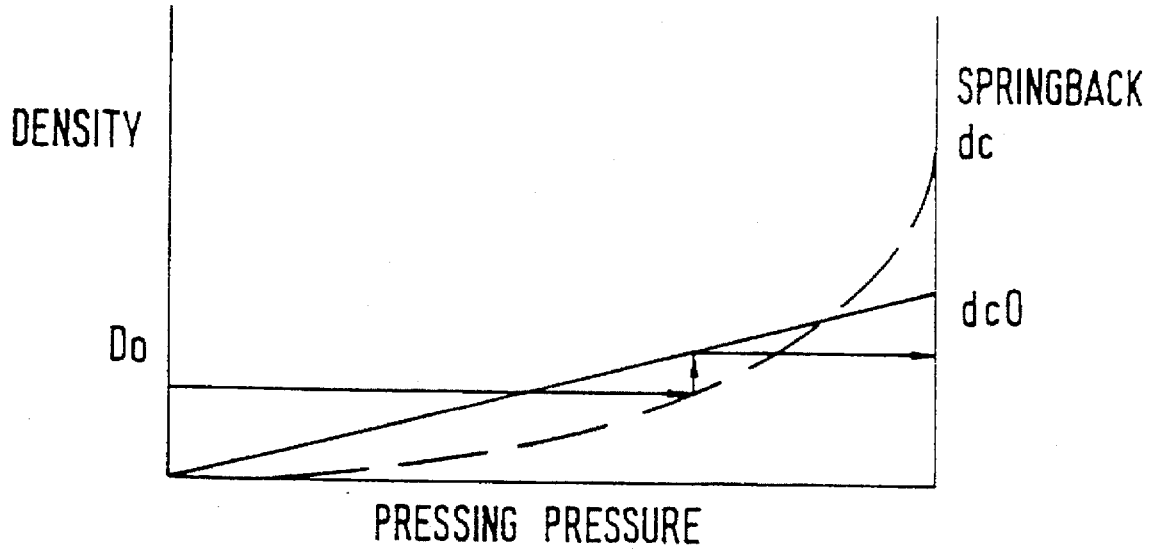
FIG. 7 is a graph showing the relationship between pressing pressure during formation of a compact, the density of the compact, and the springback of the compact after release from the die.

The third step of calibration, step (c), is the determination, for a required final pressing density do, the springback dco that would occur in conventional dies such as those illustrated in FIGS. 1*a* to 3. The relationship of this springback dco is shown in FIG. 7, in which the abscissa coordinate indicates pressing pressure during formation of the compact. The ordinate coordinate shows in respect of the broken line the density of the compact and shows in respect of the continuous line the springback dc.

Figure 8:
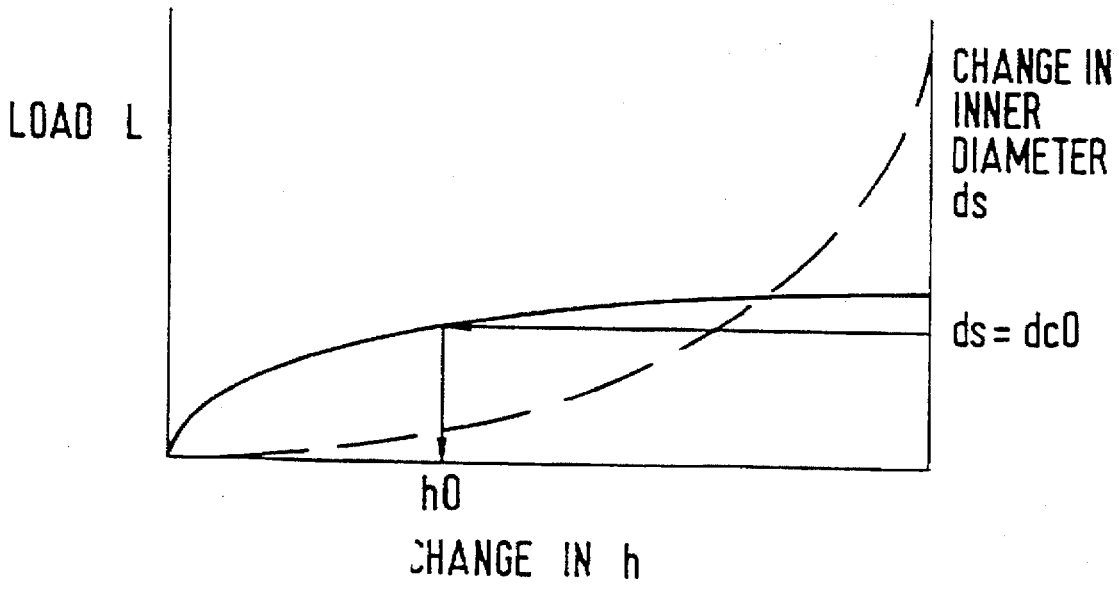
FIG. 8 is a graph showing diagrammatically the relationship between the extent of insertion of a sleeve in accordance with an embodiment of the invention into a die, the load applied to the sleeve, and the change in inner diameter of the sleeve during insertion.

The fourth step, step (d), is to determine the change in height ho that is required to give a value of ds equal to dco, as illustrated in FIG. 8. In FIG. 8 the abscissa coordinate shows change in h. The ordinate coordinate shows, in respect of the broken line the change in inner diameter ds, and shows in respect of the continuous line the load L applied to force the sleeve into the die. Determination of the change in height ho that is required to give a value of ds equal to dco, effectively ensures that the elastic recovery of the die diameter on ejection is equal to increase in diameter of the compact when unconstrained.

There will now be described with reference to FIGS. 9 and 10 an example of production tooling to put into effect the embodiment of the invention explained diagrammatically with reference to FIGS. 4 to 4*f*. Components which correspond to components in the earlier figures are indicated in FIGS. 9 and 10 by the same reference numerals. A die 12 has an internal taper along its internal face 17, and a sleeve 16 has a taper on its external face 18, corresponding to the taper of the die 12. The taper is approximately 2°. In FIG. 9 a lower punch 14 is shown and in FIG. 10 the lower punch 14 and an upper punch 13 are both shown. The finished product, a compact 15, is in this case in the shape of a ring, formed by an internal core 19, centrally placed in the bore of the die 12. The core 19 is moveable vertically during compression to accommodate the downward movement of the upper punch 13, in conventional manner. In the example shown, the core 19 is conventional, of constant outer diameter, but other embodiments the core 19 may be made to expand elastically before compression, and to contract on release of the compact from the die, in accordance with the present invention. FIG. 9 shows the apparatus in an initial stage of the filing and compressing cycle, and FIG. 10 shows the apparatus in the final stage when the compact 15 has been fully compressed.

The tooling consists of a die holder 20 into which is located the die 12. The die 12 is a multicomponent die, but is assembled so as to be a single continuous unit. Two low pressure seals 21 and 22 are positioned between the die 12 and die holder 20. A radial member 23 engages sleeve 16 at the top thereof, in a cooperating circumferential groove 24 in the sleeve 16. The radial member 23 is bolted to a piston 25 which can move vertically relative to the die holder 20 and a outer retaining structure 26, which is bolted to the die holder 20. The radial member 23 is actuated by the piston 24 in operation as will be explained hereinafter. The piston 25 can slide in the annular opening provided between the die holder 20 and the outer retaining structure 26. The piston 25 has a lower space 27 into which oil can be pressurised to move the piston 25 upwardly, and therefore to push out the sleeve 16 from the die 12. The lower space 27 is contained by high pressure seals 28, 29 and 30. An upper space 31 is provided into which oil may also be pressurized in a controlled cycle, to move the piston 25 downwardly and consequently to move the sleeve 16 into the die 12. The upper space 31 is contained by high pressure seals 28 and 32. The whole assembly is held in a press bolster by the retaining structure 26. A subsidiary power pack (not shown)

delivers high pressure oil to the upper and lower spaces 31 and 27 at the correct time during the press cycle. These times are taken from a master cam (not shown) on the press, the position of which is converted into press angle, between 0 and 360° in conventional manner. By way of example, the dimensions of the sleeve may be as follows.

| | |
|---|---|
| Length: | 103.60 mm |
| Inner diameter: | 44.66 mm |
| Outer diameter at top: | 55.85 mm |
| Outer diameter at bottom: | 49.68 mm |
| Depth of groove 24: | 10.00 mm |

The operation of the apparatus will now be described. Starting from an initial position shown in FIG. 9 with the top punch 13 removed from the die 12, the cycle is as follows. The upper space 31 is pressurized to push the sleeve 16 into the die 12. The internal dimensions of the sleeve 16 are consequently reduced, as has been explained hereinbefore. The degree of reduction of internal dimensions of the sleeve can be varied, by varying the degree of movement of the radial member 23 by the piston 25. Conveniently the degree of movement of the sleeve into the die can be determined by placing spacers between the radial member 23 and the top of the die 12. In the present case, pressurized oil is admitted to the upper space 31 until the undersurface of the radial member 23 rests on the upper surface of the die 12. The powder to form the compact 15 is then placed in the interior of the lining 16 of the die 12, in this case with a core 19 protruding upwardly through the powder. The top punch 13 then enters the die and descends relative to the lower punch 14 and the sleeve 16. The compact 15 is thus produced by compression, as shown in FIG. 10. During the entry of the upper punch 13 into the die, the core 19 descends to the position shown in FIG. 10. During the compression, the lower punch 14 rises relative to the sleeve 16 and the powder 15.

In practice in the embodiment shown, the movements which have been described in relative terms, are not absolute. In known manner in double ended presses, the lower punch 14 stays stationery in an absolute position in the press bolster and the effect of the lower punch compressing the material is achieved by the entire assembly of die holder 20 and retaining structure 26, being lowered during the press cycle. Thus the double ended compression is achieved by the lower punch 14 remaining stationary the die 12 descending through one measured distance, and the upper punch 13 descending through twice the predetermined distance.

After the compression is completed as shown in FIG. 10, the upper space 31 is depressurized. The top punch 13 is withdrawn by the normal press cycle. The lower space 27 is pressurized to push upwardly the sleeve 16 with the compact 16 still inside it. During the sleeve withdrawal the internal dimensions of the sleeve revert to their original, larger dimensions, and there is no relative vertical movement between the compact 15 end the sleeve 16 during this expansion. The bottom punch 14 is then used to eject the compact from the sleeve. The lower space 27 is then finally depressurised.

The materials used for the die 12, the sleeve 16 and the punches 13 and 14, are conventional tool steel compositions, conveniently AISI D3/D6. Examples are as follows.

TABLE A

Tooling Materials

| | Composition of Tooling Materials by weight % | | | | | | | | | |
|---|---|---|---|---|---|---|---|---|---|---|
| Material | C | Cr | Mo | V | Mn | W | Si | Co | Ni | Fe |
| AISI D2 | 1.55 | 12 | 0.7 | 1 | | | | | | bal |
| AISI D3/D6 | 2.05 | 12.5 | | | 0.8 | 1.3 | 0.3 | | | bal |
| AISI M2 | 0.9 | 4.1 | 5 | 1.9 | | 6.4 | | | | bal |
| AISI M3/2 | 1.28 | 4.2 | 5 | 3.1 | | 6.4 | | | | bal |

FIGS. 11*a* and 11*b* show respectively a plan view and a section of a sleeve suitable for use in the apparatus of FIGS. 9 and 10, to produce a gearwheel shown in FIGS. 12*a* and 12*b*. The dimensions of such a component and sleeve may be as follows. Outer diameter of sleeve at top 102.20 mm; outer diameter of sleeve at bottom 98.00 mm; length of sleeve 60.00 mm; taper of sleeve 2°; outer diameter of gear wheel 93 mm.

EXAMPLES

There will now be described a series of examples of the production of compacts of different materials, made by a conventional method and by the method of the invention. Where a compact is produced by a conventional die, the die is a double ended pressing die such as shown in FIGS. 1*a* to 3. Where a compact is made in accordance with the invention, it is made by a double ended pressing apparatus of the kind shown diagrammatically in FIGS. 4 to 4*e*, and, in a production example, in FIGS. 9 and 10. Where reference is made to the use of hand set dies, this refers to a hand-operated trial set of dies and punches. Where reference is made to production tooling, this refers to the production tooling apparatus shown in FIGS. 9 and 10. The materials used in the examples are as follows.

TABLE B

Composition of Materials Used for Compacts

| | Composition by Weight % | | | | | | | | | |
|---|---|---|---|---|---|---|---|---|---|---|
| Material | C | S | P | Mn | Mo | Ni | Si | Cr | Cu | Fe |
| NC100.24 | 0.02 | | | | | | | | | bal |
| Atomet 1001 | 0.003 | | | | | | | | | bal |
| Atomet 4601 | 0.003 | 0.009 | 0.012 | 0.2 | 0.55 | 1.8 | 0.003 | 0.005 | 0.02 | bal |
| 316L stainless st. | 0.016 | 0.009 | | | 2.55 | 12.9 | 0.88 | 17.9 | | bal |

In each table of results in the Examples, the headings of the columns have the following meanings. Pressing Pressure indicates the pressure in tons per square inch applied to the powder to be compressed, by the double ended pressing. Density indicates the density of the compact in grammes per cc, after ejection of the compact from the press. % springback indicates the expansion of the compact after ejection from the die, defined as follows:

$$\% \text{ springback} = \frac{(\text{diameter of compact after ejection} - \text{diameter of die})}{(\text{diameter of die})} \times 100$$

The column headed "Die scoring or compact cracking" indicates by an x those samples where unacceptable difficulties arose from the high Dressing pressure used, either by scoring of the internal surface of the die due to sticking of the compact during ejection, and/or the presence of cracking in the compact after ejection, due to the partial expansion of the compact as it became partially ejected from the die.

Example 1

(NC100.24)

Cylindrical compacts were made from NC100.24 ferrous powder using a conventional double ended pressing die with different amounts of lubrication, by zinc stearate, giving the following results.

TABLE 1

Conventional Pressing
Material Compressed: NC100.24 + 0.8% zinc stearate.

| Pressing Pressure tsi | Density g/cc | % Springback | Die scoring or compact cracking |
|---|---|---|---|
| 45.2 | 7.05 | 0.281 | |
| 50.9 | 7.08 | 0.307 | |
| 56.5 | 7.14 | 0.346 | |
| 65.7 | 7.16 | 0.316 | x |
| 78.8 | 7.21 | 0.335 | x |

Table 2: Conventional Pressing

TABLE 2

Conventional Pressing
Material Compressed: NC100.24 + 0.6% zinc stearate

| Pressing Pressure tsi | Density g/cc | % Springback | Die scoring or compact cracking |
|---|---|---|---|
| 52.5 | 7.13 | 0.252 | |
| 65.7 | 7.25 | 0.292 | |
| 78.8 | 7.29 | 0.328 | x |

Table 3: Conventional Pressing

TABLE 3

Conventional Pressing
Material compressed: NC100.24 + 0.4% zinc stearate

| Pressing Pressure tsi | Density g/cc | % Springback | Die scoring or compact cracking |
|---|---|---|---|
| 28.3 | 6.63 | 0.171 | |
| 33.9 | 6.88 | 0.207 | |
| 39.6 | 6.99 | 0.244 | |
| 45.2 | 7.12 | 0.265 | x |
| 50.9 | 7.18 | 0.289 | x |
| 65.7 | 7.32 | 0.284 | x |
| 78.8 | 7.38 | 0.328 | x |

Table 4: Conventional Pressing

TABLE 4

Conventional Pressing
Material Compressed: NC100.24 + 0.2% zinc stearate.

| Pressing Pressure tsi | Density g/cc | % Springback | Die scoring or compact cracking |
|---|---|---|---|
| 11.3 | 5.49 | 0.102 | |
| 16.9 | 6.03 | 0.118 | |
| 22.6 | 6.34 | 0.131 | |
| 28.3 | 6.63 | 0.173 | x |
| 33.9 | 6.84 | 0.184 | x |

A series of compacts was then produced by means of an elastically compressible lining in a method embodying the invention. Compacts were produced using a hand set as shown in FIGS. 4 to 4*f*, and having the following parameters.

TABLE C

Handset. Hand Operated die set

| Applied Sleeve Load tonnes | Diameter Ds mm | Reduction in Diameter ds mm | % ER |
|---|---|---|---|
| 0 | 32.157 | 0 | 0 |
| 5 | 32.0895 | 0.0675 | 0.21 |
| 7.5 | 32.074 | 0.078 | 0.243 |
| 10 | 32.06 | 0.097 | 0.302 |
| Ejection load on sleeve 5 t. | | | |

Applied sleeve load means the load in tons applied to the top of the sleeve (for example as shown in FIGS. 4 and 4*a*) to force the sleeve into the tapered die. Diameter Ds means the diameter of the interior of the sleeve which diminishes as the sleeve is forced into the conical die, measured in millimeters. Reduction in diameter, ds, means the reduction in the internal diameter of the sleeve produced by application of the load shown. % ER means the elastic recovery of the sleeve after release from the die measured as a % of the increase in internal diameter of the sleeve upon release, defined as follows:

$$\% ER = \frac{(\text{Unrestrained bore of sleeve} - \text{constrained bore of sleeve})}{(\text{Unrestrained bore of sleeve})} \times 100$$

Cylindrical compacts were made from NC100.24 ferrous powder using a double ended pressing die embodying the invention, as shown in FIGS. 4 to 4*f*, with different amounts of lubrication by zinc stearate, with the following results.

TABLE 5

Pressing by an Embodiment of the Invention
Material compressed: NC100.24. Hand Operated Die Set.
Sleeve fully inserted. No die scoring or compact cracking found.

| Lubrication | ds (mm) | % ER Springback % | Pressing Pressure tsi | Eject. pressure tons | Density g/cc |
|---|---|---|---|---|---|
| 0.8% zinc stearate | 0.097 | 0.302 0.28 at 50 tsi | 48 | 0 | 7.13 |
| 0.8% zinc stearate | 0.097 | 0.302 0.295 at 55 tsi | 56 | >5 t | 7.24 |
| 0.8% zinc stearate | 0.097 | 0.302 0.325 at 65 tsi | 64 | >5 t | 7.29 |

TABLE 5-continued

Pressing by an Embodiment of the Invention
Material compressed: NC100.24. Hand Operated Die Set.
Sleeve fully inserted. No die scoring or compact cracking found.

| Lubrication | ds (mm) | % ER | Springback % | Pressing Pressure tsi | Eject. pressure tons | Density g/cc |
|---|---|---|---|---|---|---|
| 0.8% zinc stearate | 0.097 | 0.302 | 0.34 at 70 tsi | 72 | >5 t | 7.31 |
| 0.8% zinc stearate | 0.097 | 0.302 | 0.356 at 80 tsi | 80 | >5 t | 7.39 |
| die wall lubrication | 0.097 | 0.302 | 0.120 at 40 tsi | 48 | 0 | 7.19 |
| die wall lubrication | 0.097 | 0.302 | 0.120 at 40 tsi | 56 | 0 | 7.33 |
| die wall lubrication | 0.097 | 0.302 | 0.120 at 40 tsi | 64 | 0 | 7.43 |
| die wall lubrication | 0.097 | 0.302 | 0.120 at 40 tsi | 72 | 0 | 7.4 |
| die wall lubrication | 0.097 | 0.302 | 0.259 at 80 tsi | 80 | 0 | 7.54 |

A series of compacts was then produced using the production tooling as shown in FIGS. 9 and 10, and having the following parameters.

TABLE D

| | |
|---|---|
| Production Tooling | |
| Sleeve Internal diameter | |
| Initial diameter (mm) | 44.665 |
| Elastically constrained diameter (mm) | 44.504 |
| % Elastic recovery possible | 0.34 |

Cylindrical compacts were made from NC100.24 ferrous powder using a double ended pressing die embodying the invention, as shown in FIGS. 9 and 10, with different amounts of lubrication by zinc stearate and with wall lubrication, with the following results.

TABLE 6

Pressing by an Embodiment of the Invention
Material compressed: NC100.24. Production Tooling.
Sleeve fully inserted. No die scoring or cracking of compacts found.

| Lubrication | ds (mm) | % ER | Springback % | Pressing Pressure tsi | Density g/cc |
|---|---|---|---|---|---|
| 0.8% zinc stearate | 0.161 | 0.34 | 0.34 at 70 tsi | 70 | 7.09 |
| 0.4% zinc stearate | 0.161 | 0.34 | 0.32 at 65 tsi | 65 | 7.31 |
| 0.4% zinc stearate | 0.161 | 0.34 | 0.33 at 75 tsi | 75 | 7.35 |
| 0.4% zinc stearate + die wall lubric. | 0.161 | 0.34 | 0.33 at 75 tsi | 75 | 7.4 |
| die wall lubric. | 0.161 | 0.34 | | 75 | 7.5 |

The results in the tables, Table 5 and Table 6, are comparable with results in Tables 1, 2, 3 and 4. Note that, in Table 1, 2, and 3, as the amount of lubricant in the powder decreases the compacts become more and more difficult to eject from the conventional die without damage. The safe pressing pressure drops from about 55 tsi with 0.8% zinc stearate to about 25 tsi with 0.2% zinc stearate added as lubricant. Table 5 shows that all compacts in the elastic die handsets were ejected without damage and with low ejection forces. It can also be seen in Table 5, that as the expected springback (% SB) of the compressed powder compact increases, (figures taken from data in Table 1) the ejection force only becomes positive when its value exceeds the elastic recovery (% ER) of the sleeve. With die wall lubrication in Table 5, all compacts were ejected with zero ejection force as the expected % springback even at 80 tsi (0.259%) was less than the elastic recovery of the sleeve (0.302%).

Table 6 illustrates that the production tooling, designed to give an elastic recovery (0.34%), approximately equal to the springback expected with NC100.24 at 80 tsi using die wall lubrication (0.34%), produced sound compacts of high density with practically zero ejection force.

Example 2

(316L Stainless Steel)

A similar series of sets of compacts was then produced using 316L stainless steel, by conventional means, and by embodiments of the present invention, with the following results.

TABLE 7

Conventional Pressing
Material Compressed:
316L Stainless steel + 1% lithium stearate

| Pressing Pressure tsi | Density g/cc | % Springback | Die scoring or compact cracking |
|---|---|---|---|
| 39.6 | 6.6 | 0.254 | |
| 45.2 | 6.73 | 0.283 | |
| 50.9 | 6.83 | 0.294 | |
| 56.5 | 6.94 | 0.323 | x |
| 65.7 | 7 | 0.324 | x |
| 78.8 | 7.1 | 0.358 | x |

Table 8: Conventional Pressing

TABLE 8

Conventional Pressing
Material Compressed:
316L stainless steel + 0.6% lithium stearate

| Pressing Pressure tsi | Density g/cc | % Springback | Die scoring or compact cracking |
|---|---|---|---|
| 33.9 | 6.43 | 0.257 | |
| 39.6 | 6.57 | 0.275 | |

TABLE 8-continued

| Conventional Pressing Material Compressed: 316L stainless steel + 0.6% lithium stearate | | | |
|---|---|---|---|
| Pressing Pressure tsi | Density g/cc | % Springback | Die scoring or compact cracking |
| 45.2 | 6.7 | 0.294 | |
| 50.9 | 6.83 | 0.312 | x |
| 56.5 | 6.93 | 0.338 | x |
| 65.7 | 7.01 | 0.338 | x |
| 78.8 | 7.15 | 0.344 | x |

TABLE 9

| Conventional Pressing Material Compressed: 316L stainless steel + 0.4% lithium stearate | | | |
|---|---|---|---|
| Pressing Pressure tsi | Density g/cc | % Springback | Die scoring or compact cracking |
| 16.9 | 5.7 | 0.215 | |
| 22.6 | 6.01 | 0.244 | |
| 28.3 | 6.24 | 0.257 | |
| 33.9 | 6.54 | 0.265 | x |
| 39.6 | 6.58 | 0.275 | x |
| 45.2 | 6.73 | 0.299 | x |
| 50.9 | 6.86 | 0.331 | x |
| 56.6 | 6.92 | 0.341 | x |
| 65.7 | 7.07 | 0.312 | x |
| 78.8 | 7.17 | 0.34 | x |

TABLE 10

| Pressing by an Embodiment of the Invention Material compressed: 316 Stainless Steel. Hand Operated Die Set. Sleeve fully inserted. No die scoring of compact cracking found. | | | | | | |
|---|---|---|---|---|---|---|
| Lubrication | ds (mm) | % ER | Springback % | Pressing Pressure tsi | Eject. press. tons | Density g/cc |
| 1% lithium stearate | 0.097 | 0.302 | 0.29 at 50 tsi | 48 | 0 | 6.77 |
| 1% lithium stearate | 0.097 | 0.302 | 0.31 at 55 tsi | 56 | >5 t | 6.94 |
| 1% lithium stearate | 0.097 | 0.302 | 0.33 at 65 tsi | 64 | >5 t | 7.01 |
| 1% lithium stearate | 0.097 | 0.302 | 0.34 at 70 tsi | 72 | >5 t | 7.07 |
| 1% lithium stearate | 0.097 | 0.302 | 0.328 at 80 tsi | 80 | >5 t | 7.12 |
| 0.4% zinc stearate | 0.097 | 0.302 | 0.31 at 50 tsi | 48 | 0 | 6.75 |
| 0.4% zinc stearate | 0.097 | 0.302 | 0.325 at 55 tsi | 56 | 0 | 6.88 |
| 0.4% zinc stearate | 0.097 | 0.302 | 0.34 at 65 tsi | 64 | >5 t | 7.05 |
| 0.4% zinc stearate | 0.097 | 0.302 | 0.345 at 70 tsi | 72 | >5 t | 7.09 |
| 0.4% zinc stearate | 0.097 | 0.302 | 0.355 at 80 tsi | 80 | >5 t | 7.21 |
| die wall lubrication | 0.097 | 0.302 | 0.20 at 50 tsi | 48 | 0 | 6.61 |
| die wall lubrication | 0.097 | 0.302 | 0.22 at 55 tsi | 56 | 0 | 6.83 |
| die wall lubrication | 0.097 | 0.302 | 0.275 at 65 tsi | 64 | 0 | 6.94 |
| die wall lubrication | 0.097 | 0.302 | 0.29 at 70 tsi | 72 | >5 t | 7.09 |
| die wall lubrication | 0.097 | 0.302 | 0.34 at 80 tsi | 80 | >5 t | 7.23 |

TABLE 11

| Pressing by an Embodiment of the Invention Material compressed: 316L Stainless Steel. Production Tooling. Sleeve fully inserted. No die scoring or cracking of compacts found. | | | | | |
|---|---|---|---|---|---|
| Lubrication | ds (mm) | % ER | Springback % | Pressing Pressure tsi | Density g/cc |
| 1% lithium stearate | 0.161 | 0.302 | 0.34 at 70 tsi | 70 | 7.09 |

The results in these tables, Table 10 and Table 11, are comparable with results in Tables 7, 8 and 9. Note that, in Tables 7, 8 and 9, as the amount of lubricant in the powder decreases the compacts become more and more difficult to eject from the conventional die without damage. The safe pressing pressure drops from about 50 tsi with 1.0% lithium stearate to about 30 tsi with 0.4% lithium stearate added as lubricant. Table 10 shows that all compacts in the elastic die handsets were ejected without damage and with low ejection forces. It can also be seen in Table 10, that as the expected springback (% SB) of the compressed powder compact increases, (figures taken from data in Tables 7 and 9) the ejection force only becomes positive when its value exceeds the elastic recovery (% ER) of the sleeve. Note, for example, that the ejection force only becomes measurable at 55 tsi using 1% lithium stearate, at 65 tsi using 0.4% lithium stearate, and at 70 tsi using only die wall lubrication. In both cases these pressures are those at which the expected springback of the compressed material becomes equal to or exceeds the elastic recovery of the sleeve. Even with die wall lubrication in Table 10, all compacts were ejected with zero or low ejection force, as the expected % springback at 70 tsi (0.29%) was equal to the elastic recovery of the sleeve (0.302%).

Table 11 illustrates that the production tooling, designed to give an elastic recovery (0.34%), approximately equal to the springback expected with 316L stainless steel at 70 tsi using die wall lubrication (0.34%), produced sound compacts of high density with practically zero ejection force.

Example 3

(ATOMET 1001 AND ATOMET 4601)

Table 12 illustrates results with two further iron-based powders, Atomet 1001, a pure iron powder, and Atomet 4601 an alloy powder with compositions as in Table A. In industrial practice it is usually necessary to add graphite to ferrous powder mixes for metallurgical reasons. Springback at various pressing pressures was determined as previously described and this data (not included here) is used to explain the results in Table 12. The results show that even with an addition of graphite the compacts were all produced without damage at zero or low ejection force. Only when the % springback was equal to or exceeded the elastic recovery (% ER) of the sleeve did the ejection force become noticeable. The high densities attainable, up to 7.65 g/cc without cracking could not be obtained with conventional tooling.

As stated previously the results also show that when the expected springback of the compacted material becomes equal to, or greater than the elastic recovery of the sleeve the ejection force become positive, but still small enough to allow compacts to be removed rom the tools without damage.

TABLE 12

Pressing by an Embodiment of the Invention
Material compressed: Various. Hand Operated Die Set.
Sleeve fully inserted. No die scoring of compact cracking found.

| Lubrication | ds (mm) | % ER | Springback % | Pressing Pressure tsi | Eject. press. t | Density g/cc |
|---|---|---|---|---|---|---|
| Atomet 1001 | 0.097 | 0.302 | | 48 | 0 | 7.37 |
| Atomet 1001 | 0.097 | 0.302 | | 56 | 0 | 7.48 |
| Atomet 1001 | 0.097 | 0.302 | | 64 | 0 | 7.57 |
| Atomet 1001 | 0.097 | 0.302 | | 72 | 0 | 7.63 |
| Atomet 1001 | 0.097 | 0.302 | 0.34 at 80 tsi | 80 | 0 | 7.65 |
| Atomet 1001 + 0.5% graphite | 0.097 | 0.302 | 0.284 at 80 tsi | 80 | >5 t | 7.59 |
| Atomet 4601 | 0.097 | 0.302 | | 48 | 0 | 7.14 |
| Atomet 4601 | 0.097 | 0.302 | | 56 | 0 | 7.3 |
| Atomet 4601 | 0.097 | 0.302 | | 64 | 0 | 7.41 |
| Atomet 4601 | 0.097 | 0.302 | | 72 | 0 | 7.48 |
| Atomet 4601 | 0.097 | 0.302 | 0.284 at 80 tsi | 80 | 0 | 7.55 |
| Atomet 4601 + 0.5% graphite | 0.097 | 0.302 | 0.21 at 50 tsi | 48 | 0 | 7.1 |
| Atomet 4601 + 0.5% graphite | 0.097 | 0.302 | 0.23 at 55 tsi | 56 | 0 | 7.32 |
| Atomet 4601 + 0.5% graphite | 0.097 | 0.302 | 0.27 at 66 tsi | 64 | 0 | 7.36 |
| Atomet 4601 + 0.5% graphite | 0.097 | 0.302 | 0.315 at 75 tsi | 75 | >5 t | 7.43 |
| Atomet 4601 + 0.5% graphite | 0.097 | 0.302 | 0.318 at 80 tsi | 80 | >5 t | 7.5 |

The embodiments described above related to sleeves that form the outside shape of the component. Centrally placed core rods, and off-centre core rods have to be dealt with in a different mechanical arrangement but still using the elastic recovery technique. In the case of core rods the external dimensions of the core rod have to be made larger before compaction. After compaction the original dimensions then need to be recovered, that is the external dimensions decrease. This makes it possible for the ore rod to be withdrawn from the component with zero, or very much reduced force. This not only prevents damage to the component, but also to the core rod itself. Expansion of the core rod is effected by having a sleeve on the outside of the core rod with a taper on the insider surface of the sleeve. When the sleeve is pulled over the core rod, which has a matching taper, or when the core rod is driven into this external sleeve, the external dimensions of the sleeve are increased in the same manner that the internal dimensions of the die sleeve decrease when the sleeve is pulled into the die. After compaction, the sleeve is pushed off the core rod, or the core rod is withdrawn from the sleeve allowing it to elastically recover to its original smaller external dimensions. The compact is then withdrawn from the die and the core rods removed with zero or low force.

I claim:

1. A method of producing a product by compression of material, comprising the steps of:

providing in a hollow die a compressed lining which is elastically compressed so as to reduce the internal size of the lining relative to the internal size before compression, compressing product material in the lining to produce a compressed product, releasing the lining at least partially from the die to produce an increase in the internal size of the lining, and removing the compressed product from the lining, in which the lining is continuous around the interior of the die, and the method includes compressing the lining by a smooth, continuous, elastic deformation of the bulk material of the lining, so as to reduce the internal size of the lining while maintaining the accuracy of the internal shape of the lining.

2. A method according to claim 1 including the step of compressing the lining before the step of compressing the product material to produce the compressed product.

3. A method according to claim 2 including the step of producing an adjustable, selectable, compression of the lining, whereby the increase in internal size of the lining on release of the lining from the die can be selected in relation to the expected increase in external size of the product on release from the die.

4. A method according to claim 2 including compressing the lining to an extent such that the increase in internal size of the lining on release of the lining from the die is in the range + or −10% of the increase in external size of the product on release from the die.

5. A method according to claim 2 including compressing the lining to an extent such that the increase in internal size of the lining during the release from the die is substantially equal to the expansion of the product after release from the die.

6. A method according to claim 1 in which the lining is a sleeve and the method includes inserting the sleeve into the die along the direction of a common axis of the sleeve and the die, and in which the interior of the die and the exterior surface of the sleeve are both tapered in the direction of the common axis so that insertion of the sleeve produces compression of the sleeve by the die.

7. A method according to claim 6 in which the angle of taper of the die and the sleeve is in the range 1 to 5°.

8. A method according to claim 7 in which the angle of taper of the die is about 2°.

9. A method according to claim 6 in which the hollow die is provided by an aperture in a die and the method includes compressing the material by moving upper and lower punches into the aperture in the die in the interior of the lining.

10. A method according to claim 6 including calibrating the die and lining by the steps of:

(a) pressing the sleeve into the die and measuring the change in inner diameter of the sleeve as a function of the change in axial position of the sleeve;

(b) for any particular product material, measuring the compressibility and spring back as a function of the pressing pressure;

(c) for a required pressing density during production of a compressed product, determining from the information of step (b) the spring back which would occur in a conventional die; and (d) determining from the data acquired in the extent of insertion of the sleeve that is required to give a value of decrease of inner diameter of the sleeve which is equal to the expected spring back determined in step (c), or falls within a predetermined range of deviation from that springback.

11. A method according to claim 1 including forming an opening in the compressed product by a core provided in the hollow die, including the steps of:

expanding elastically the external size of the core and compressing the product material in the die around the expanded core;

after the compression of the product material, reducing the external size of the core; and removing the core from the compressed product.

12. Apparatus for producing a product by compression of material comprising:

a hollow die;

an elastically compressible lining for the die;

means for compressing the lining to provide in the die a compressed lining of reduced internal size;

means for compressing material in the interior of the lining when inside the die, and means for releasing the lining at least partially from the die to produce an increase in the internal size of the lining to allow removal of the compressed product from the lining, in which the lining is a continuous lining for the interior of the die, and the lining has when uncompressed, an external size greater than the internal size of the die, the means for compressing the lining comprising means for forcing the elastically compressible lining into the die to compress the lining by a smooth, continuous, elastic deformation of the bulk material of the lining, so as to reduce the internal size of the lining while maintaining the accuracy of the internal shape of the lining.

13. A method of producing a product by compression of material, comprising the steps of:

providing in a hollow die a core to form a required opening in the final product;

compressing product material in the die around the core to produce a compressed product; and after the compression of the product material, removing the compressed product from the die and from the core;

in which the method includes expanding elastically the external size of the core and compressing the product material in the die around the expanded core, and, after the compression of the product material, reducing the external size of the core to assist removal of the compressed product from the core, the core being continuous around its external surface, and the exterior of the core being expanded by a smooth continuous elastic deformation so as to increase the external size of the core while maintaining the accuracy of the external shape of the core.

14. A method of producing a product by compression of material, comprising the steps of:

providing in a hollow die a compressed sleeve which is elastically compressed so as to reduce the internal size of the sleeve relative to the internal size before compression, inserting into the compressed sleeve a material to be compressed, compressing the material in the sleeve to produce a compressed product, releasing the sleeve at least partially from the die to produce an increase in the internal size of the sleeve, and removing the compressed product from the sleeve, in which the interior surface of the die and the exterior surface of the sleeve are both tapered, and the method includes the step of inserting the tapered sleeve into the tapered die and compressing the sleeve by the effect of the tapered surfaces before the compression of the product material in the sleeve, to produce a selectable compression of the lining depending upon the extent of insertion of the sleeve into the die, whereby the increase in internal size of the lining on release of the lining from the die can be selected in relation to the expected increase in external size of the product on release from the die.

15. Apparatus for producing a product by compression of material comprising:

a hollow die;

an elastically compressible lining for the die;

means for compressing the sleeve to provide in the die a compressed sleeve of reduced internal size;

means for compressing material in the interior of the sleeve when inside the die, and means for releasing the sleeve at least partially from the die to produce an increase in the internal size of the sleeve to allow removal of the compressed product from the sleeve;

in which the interior surface of the die and the exterior surface of the sleeve are both tapered, and the means for compressing the sleeve comprises means for forcing the sleeve into the die independently of the means for compressing the product material in the interior of the sleeve, to produce a selectable compression of the lining depending upon the extent of insertion of the sleeve into the die, whereby the increase in internal size of the lining on release of the lining from the die can be selected in relation to the expected increase in external size of the product on release from the die.

* * * * *